United States Patent [19]

Tedd et al.

[11] 4,429,202

[45] Jan. 31, 1984

[54] SWITCH ACTUATOR MECHANISM

[75] Inventors: David C. Tedd, Folkestone; Kenneth Gatland, Walmer, both of England

[73] Assignee: Thorn EMI Instruments Limited, Dover, England

[21] Appl. No.: 398,352

[22] Filed: Jul. 15, 1982

[30] Foreign Application Priority Data

Jul. 16, 1981 [GB] United Kingdom ..... 8121934

[51] Int. Cl.[3] ..... H01H 9/20

[52] U.S. Cl. ..... 200/324; 200/16 R; 200/318; 200/329; 200/252

[58] Field of Search ..... 200/291, 318, 319, 320, 200/321, 322, 324, 325, 327, 329, 16 B, 16 C, 16 D, 16 R, 252, 293

[56] References Cited

U.S. PATENT DOCUMENTS

| | | | |
|---|---|---|---|
| 3,757,060 | 9/1973 | Ianuzzi et al. | 200/16 C |
| 4,075,442 | 2/1978 | Fukuda et al. | 200/291 X |
| 4,152,565 | 5/1979 | Rose | 200/291 |
| 4,322,588 | 3/1982 | Chumley et al. | 200/16 D X |
| 4,324,957 | 4/1982 | Josemans | 200/291 X |

FOREIGN PATENT DOCUMENTS

| | | | |
|---|---|---|---|
| 884009 | 7/1943 | France | 200/291 |

OTHER PUBLICATIONS

*IBM Technical Disclosure Bulletin* vol. 22 no. 6 Nov. 1979 "Sliding Selector Switch".

*Primary Examiner*—John W. Shepperd
*Assistant Examiner*—Ernest G. Cusick
*Attorney, Agent, or Firm*—Fleit, Jacobson, Cohn & Price

[57] ABSTRACT

A switch actuator mechanism including a slider which can execute movement in steps along a linear track, the step-wise movement being governed by the interaction of a pair of cam-followers, carried by the slider, with respective cam-surfaces disposed alongside the track, one to either side thereof. The cam-followers are resiliently urged into contact with their respective cam surfaces and permit the slider to assume, alternately, stable and unstable conditions at locations disposed in series along the track. Beyond one of the extreme positions at which the stable condition is assumed, the cam surfaces are formed with respective inwardly inclined, linear surface portions along which the respective cam-followers can run while being urged against the resilient force, thereby permitting the slider to travel beyond the extreme stable position to enable a switch means to be actuated by the slider, or some attachment thereto, the slider being restored to the aforesaid extreme stable position, after such actuation, by the resilient force applied to the cam-followers.

4 Claims, 1 Drawing Figure

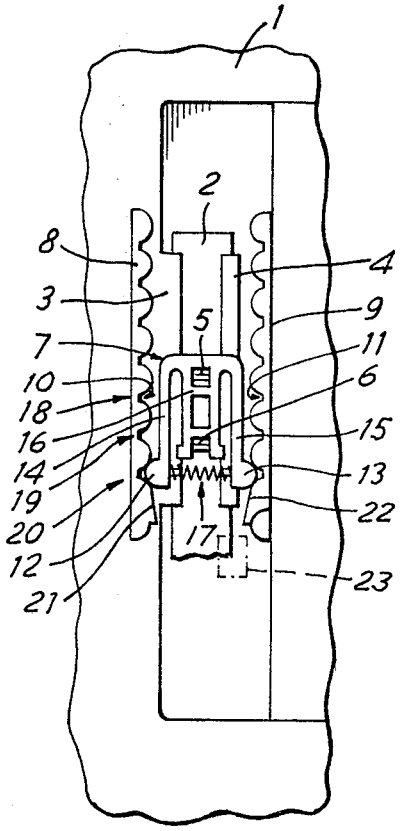
1
2
8
4
3
9
5
7
11
10
6
18
15
16
14
13
19
22
20
17
12
23
21

SWITCH ACTUATOR MECHANISM

BACKGROUND OF THE INVENTION AND FIELD OF THE INVENTION

This invention relates to actuator mechanisms for electrical switches, and it relates especially to such mechanisms for linearly slidable switches in which the arrangement is such that the slider of a switch can execute movement in steps along a linear track.

In such switches, a linear channel-defining slot is provided and the switch contacts are shifted along the slot, by means of the slider, to occupy in turn selected positions, as defined by the mechanism governing the stepped motion, so as to establish desired electrical connections.

It is an object of this invention to provide a switch actuator mechanism which not only controls such stepped, linear movement of a slider but is also capable of actuating a separate switch by resiliently restored movement beyond an extreme step position.

SUMMARY OF THE INVENTION

According to this invention there is provided a switch actuator mechanism including first and second rack members respectively disposed to either side of a linear slot in a panel member, said rack members presenting respective inwardly facing cam surfaces, a slider member formed with a part protruding through said slot for manual operation from the opposite side of said panel to that supporting said rack members, and an actuator member secured to said slider and arranged to move therewith, the actuator member including first and second cam-follower members arranged to co-operate respectively with the first and second rack members to define a series of stable and unstable locations and cause said slider member to be moveable in steps along said slot, said first and second cam-follower members being resiliently urged into contact with the cam surfaces of their respective rack members so that the stepped movement of the slider member is controlled by the co-operation of the cam-followers with the cam surfaces of the rack members, the actuator member being coupled to a linearly slidable switch contact member that establishes desired electrical connections when the slider is moved to occcupy stable locations, and wherein a separate switch is provided and positioned to be operable when said actuator member is moved beyond an extreme stable location, each of the rack members being formed, beyond the recess therein corresponding to said extreme stable location, with an inwardly sloping ramp arranged to force the respective cam-follower members inwardly against the resilient urge so that, the switch means having been actuated, the slider can be released and is automatically returned to said extreme stable location by the resilience applied to the cam-followers.

BRIEF DESCRIPTION OF THE DRAWING

In order that the invention may be clearly understood and readily carried into effect, one embodiment thereof will now be described, by way of example only, with reference to the accompanying drawing which shows, in plan view, part of an actuator mechanism in accordance with one example of the invention.

DESCRIPTION OF THE PREFERRED EMBODIMENTS

Referring now to the drawing, a casing part 1 formed, for example, of a plastics material and constituting part of the outer case of a digital multimeter, is formed with an elongated, rectangular slot which is obscured in the drawing by a slider in the form of a tongue member 2 of flexible plastics material which exactly fits the lateral dimension of the slot but exceeds the longitudinal dimension of the slot by an amount sufficient to accommodate the sliding movement, within the slot, of the switch components to be described hereinafter.

The tongue member 2 is retained in position laterally by means of shoulder members 3 and 4 which are formed integrally with the casing part 1 to either side of the slot and provide a channel within which the tongue member 2 can slide. Formed integrally with the tongue member 2 and protruding outwardly through the slot so as to be accessible from the front of the casing part is an actuating button or pip (not shown) and a pair of shoulders which, at extremes of travel of the slider, contact the laterally extending ends of the slot to define the limits of longitudinal travel of the slider.

Also formed integrally with the tongue member 2, but facing inwardly therefrom are two latch members 5 and 6 by means of which an actuator member 7 can be secured to the slider by snap-fitting as is well known in the plastics fitments art. The actuator 7 can of course move, with the slider, along the slot.

Disposed alongside the slot, and to either side thereof, are first and second rack members 8 and 9. The rack members are formed integrally with the casing art 1 and they present respective inward-facing cam surfaces 10, 11 which consist of alternate semi-cylindrical protuberances and flat lands, which form recesses between adjacent protuberances.

The actuator member 7 includes a pair of cam-follower members 12, 13 which are supported on respective arms 14, 15 cantilevered from a central portion 16 which is secured to the latch members 5 and 6 on the slider tongue 2. The cam-followers 12 and 13 are urged apart by means of a spring 17 and they thus contact the respective cam surfaces and co-operate with those surfaces to define a succession of stable and unstable locations for the slider as it is moved along the slot.

As can be seen from the drawing, the protuberances of one cam surface 10 exactly align with those of the other cam surface 11 and the flat lands of the two cam surfaces also align with one another. Thus, in each stable location, the actuator member adopts a position, like that shown in the drawing in which the cam-followers rest opposite the flat lands. When the slider is moved, the cam-followers of the actuator member 7 are urged towards one another, ride over the aligned protuberances of the two cam surfaces and then slot into the next adjacent pair of recesses.

It will be appreciated that the actuator member 7 carries switch contacts that slide relative to, for example, a printed circuit board and which establish desired electrical connections when the slider occupies stable locations.

It is sometimes desirable to combine the stepped linearly slidable switch arrangement described hereinbefore with the actuation of a "push on-push off" switch mounted within the casing. This example of the invention provides for such combined operation as will be described hereinafter.

The actuator mechanism shown has the capability of assuming three stepped positions, with the cam-followers in the flat lands aligned with arrows 18, 19 and 20 respectively. The switch can also move downwards, i.e. beyond the flat lands aligned with arrow 20, so that the cam-followers engage respective ramp inclines 21 and 22. Such downward movement of the slider causes the cam-followers to be progressively pressed closer to one another due to the relative inclination of the ramp inclines 21 and 22 and before the cam-followers have reached the ends of these inclines, the arrangement is such that either the actuator member itself or some suitably shaped member attached thereto contacts and operates the push-push switch, shown schematically at 23. This having been done, the slider member can be released and the resilience of spring 17 urges the cam-followers outwardly and thus back along the inclines 21 and 22. The cam-followers come to rest in the recesses formed by the flat lands aligned with arrow 20.

The switch 23 can be repeatedly actuated merely by pressing the slider to the end of its travel and then releasing it and each time this is done the state of switch 23 changes.

It will be observed that there are extra cam surfaces above the flat lands aligned with arrows 18. These extra surfaces are not used in a three step-plus-push switch as arrangement described and can be omitted or modified in shape if desired.

In an alternative embodiment, the switch 23 is not a push-push switch but rather a micro switch with normally open contacts that can be closed by the actuator member for test purposes.

We claim:

1. A switch actuator mechanism including a casing part having outwardly and inwardly facing surfaces, said part being formed with a slot, the said inwardly facing surface supporting first and second rack members extending respectively along opposing sides of said slot, said rack members being formed with respective cam surfaces disposed to face each other across said slot, a slider member formed with a part protruding outwardly through said slot for manual operation, said inwardly facing surface also supporting means to retain said slider member within said casing part while permitting said slider member to be moveable along said slot, and an actuator member secured to said slider and arranged to move therewith, the actuator member including first and second cam-follower members arranged to co-operate respectively with the first and second rack members to define a series of stable and unstable locations and cause said slider member to be moveable in steps along said slot, said first and second cam-follower members being resiliently urged into contact with the cam surfaces of their respective rack members so that the stepped movement of the slider member is controlled by the co-operation of the cam-followers with the cam surfaces of the rack members, and wherein a separate switch means is provided and positioned to be operable when said actuator member is moved beyond an extreme stable location, each of the rack members being formed, beyond the recess therein corresponding to said extreme stable location, with an inwardly sloping ramp arranged to force the respective cam-follower members inwardly against the resilient urge so that, the switch means having been actuated, the slider can be released and is automatically returned to said extreme stable location by the resilience applied to the cam-followers.

2. A mechanism according to claim 1 wherein said cam surfaces consist of alternate protuberances and recesses along said slot, the protuberances and recesses of one rack member being aligned with their counterparts in the other rack member.

3. A mechanism according to either of claims 1 or 2 wherein said separate switch is of the push on-push off variety.

4. A mechanism according to either of claims 1 or 2 wherein said separate switch is a micro-switch that can be moved to a test position by means of said actuator member.

* * * * *